United States Patent [19]

Jackson

[11] Patent Number: 4,555,147

[45] Date of Patent: Nov. 26, 1985

[54] DRAWER SLIDE MOUNTING BRACKET

[76] Inventor: David L. Jackson, 4025 E. Madison, Phoenix, Ariz. 85034

[21] Appl. No.: 647,921

[22] Filed: Sep. 6, 1984

[51] Int. Cl.[4] ..... F16C 29/00

[52] U.S. Cl. ..... 308/3.8

[58] Field of Search ..... 308/3.8, 3.6, 3 R; 312/334, 341 R

[56] References Cited

U.S. PATENT DOCUMENTS

| | | | |
|---|---|---|---|
| 4,138,176 | 2/1979 | Cowdroy | 308/3.6 |
| 4,141,525 | 2/1979 | Miller | 308/3.6 |
| 4,199,200 | 4/1980 | Livingston | 308/3.8 |
| 4,440,455 | 4/1984 | Lanting et al. | 308/3.8 |

*Primary Examiner*—Lenard A. Footland

*Attorney, Agent, or Firm*—Drummond & Nissle

[57] ABSTRACT

A mounting bracket for drawer rail assemblies. The bracket tightly interfits with and fixedly supports different sized drawer rail assemblies.

2 Claims, 6 Drawing Figures

DRAWER SLIDE MOUNTING BRACKET

This invention relates to mounting brackets for drawer rail assemblies.

More particularly, the invention relates to mounting brackets for drawer rail assemblies of the type including a mounting rail for receiving a roller carried on another portion of the drawer rail assembly, the mounting bracket slidably frictionally receiving and interfitting the rear end of the mounting rail.

In a further respect, the invention relates to a mounting bracket of the general type described including a pair of open ended slots formed through the bracket for receiving the rear end of the mounting rail, each slot having a pair of opposed parallel linear support edges and being sized such that when the rear end of a mounting rail is slidably frictionally interfit with the bracket the rail contacts a peripheral support edge pair including one of the peripheral edges of each of the slots.

In another respect, the invention relates to a universal drawer rail assembly mounting bracket which fits different sized mounting rails.

Drawer rail assembly mounting brackets are well known in the art and are designed to interfit and support the rear end of the mounting rail of a drawer rail assembly. See, for example, U.S. Pat. Nos. 3,149,811 to Fremstad et al, 3,675,883 to Holmes, and 4,289,290 to Miller. Such mounting brackets generally "wrap-around" and form a sleeve which receives the rear end of a mounting rail. A wrap-around bracket design generally limits use of the bracket to one standard size of mounting rail. If a mounting rail is larger than the standard size rail it will not fit into the wrap-around bracket. When a mounting rail is smaller than the standard size rail, it fits loosely in the mounting bracket and vibrates when a drawer is moved back and forth along the rail. Such vibration causes drawer rail assembly fittings to gradually work free from a cabinet. Providing a mounting bracket which can receive and securely anchor the rear ends of different brands of mounting rails is difficult because drawer rail assembly manufacturers intentionally produce mounting rails having dimensions different from those of rails manufactured by competing manufacturers.

Another drawback of conventional wrap-around mounting brackets is that they are, comparatively speaking, more costly to manufacture because more complicated fabrication techniques or additional production steps are required to produce the portion of the bracket which wraps around the mounting rail. For instance, forming the side wings 28, 30 shown in FIG. 5 of U.S. Pat. No. 4,289,290 to Miller requires an additional production step to bend metal wings 28, 30 to the position of FIG. 5 from their original position in the imaginary plane passing through mount plate 24.

Accordingly, it would be highly desirable to provide an improved drawer rail assembly mounting bracket which would interfit and securely support the rear end of each of a plurality of different sized mounting rails and which would be less costly to manufacture than conventional wrap-around drawer rail assembly mounting brackets.

Therefore, it is a principal object of the invention to provide an improved mounting bracket for a drawer rail assembly.

Another object of the invention is to provide an improved drawer rail assembly mounting bracket which is of simple manufacture and will interfit and support different sized mounting rails.

These and other, further and more specific objects and advantages of the invention will be apparent to those skilled in the art from the following detailed description thereof, taken in conjunction with the drawing, in which.

Figures 1, 2, 3, 4, 5, 6:
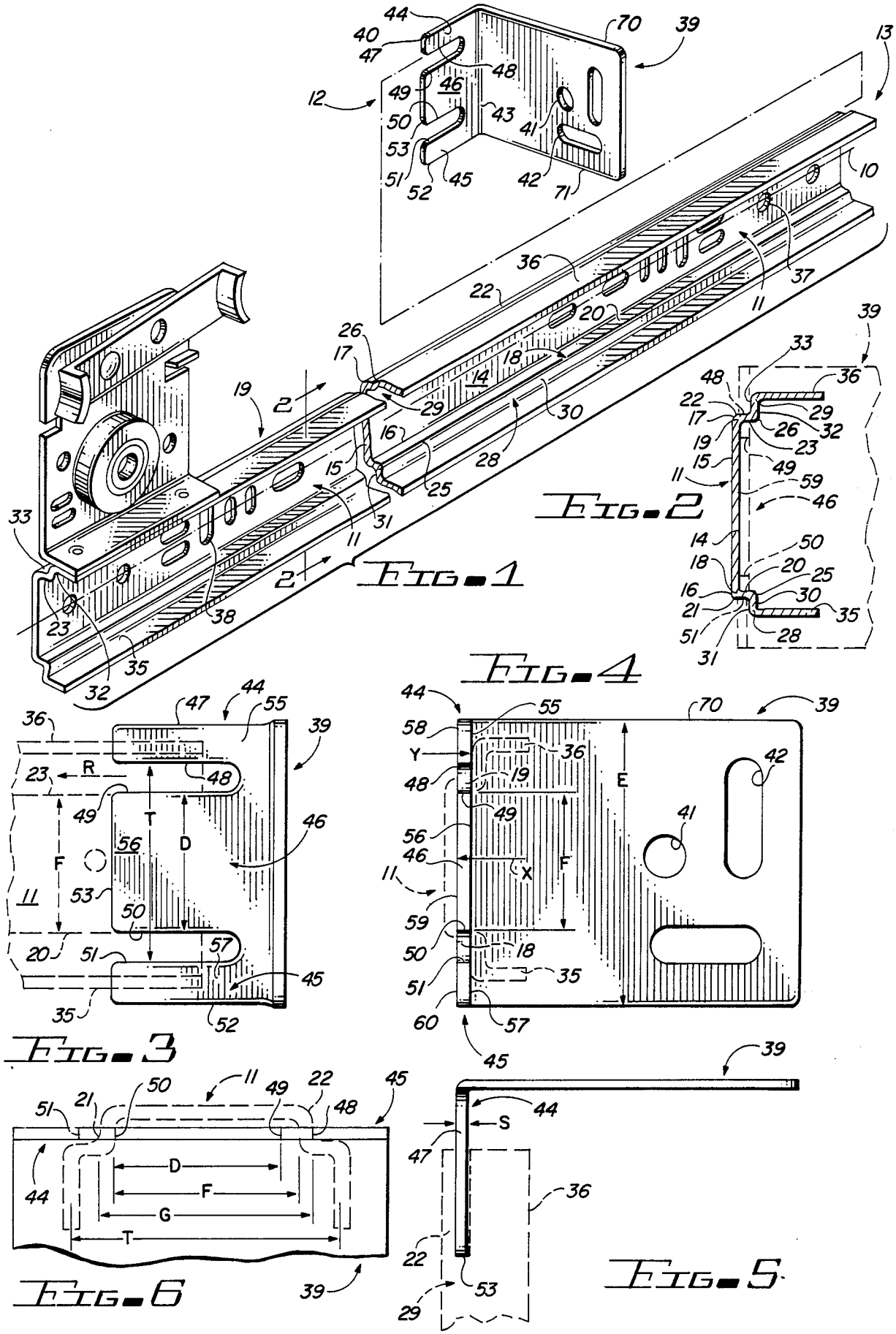
FIG. 1 is a perspective assembly view illustrating the mounting bracket and drawer rail assembly of the presently preferred embodiment of the invention.
FIG. 2 is a section view of the mounting rail of FIG. 1 taken along section line 2—2 thereof and illustrating in ghost outline the position of the mounting bracket of the invention thereon.
FIG. 3 is a side view of the mounting bracket of FIG. 1 illustrating in ghost outline the interfitting of a mounting rail thereon.
FIG. 4 is a front view of the mounting bracket of FIG. 3 illustrating in ghost outline the interfitting of the bracket with the mounting rail of FIG. 3.
FIG. 5 is a top view of the mounting bracket and mounting rail of FIG. 4; and, FIG. 6 is a partial front view of the mounting bracket of FIG. 1 illustrating in ghost outline the interfitting of a mounting rail therewith.

Briefly, in accordance with my invention, I provide a mounting bracket for the rear end of the mounting rail of either of a pair of drawer rail assemblies. Each drawer rail assembly includes an elongate panel having planar front and back surfaces, a longitudinal axis, and a pair of opposed edges generally parallel to one another and said longitudinal axis, the shortest distance between the opposed edges being different for each of the drawer rail assemblies, first and second opposed flanges attached to the elongate panel along the edges thereof and outwardly extending from the front surface thereof, the flanges each having generally planar parallel upper and lower surfaces and an outer edge spaced away from and generally parallel to the elongate panel, the shortest distance between the upper and lower planar surfaces of each of the first and second flanges comprising the thickness of each flange; and, third and fourth flanges each attached to one of the outer edges of the first and second flanges. The third and fourth flanges each have generally planar parallel forward and rear surfaces generally parallel to the elongate panel and each extend outwardly away from the first and second flanges and the panel member. The rear surfaces of the third and fourth flanges generally lie in the same imaginary plane, and an imaginary plane passing through the front surface of the elongate panel is generally parallel to and spaced apart from the imaginary plane passing through the rear surfaces of the third and fourth flanges. The elongate panel and first, second, third and fourth flanges terminate at the rear end of the mounting rail. The one piece mounting bracket slidably frictionally engages and supports the mounting rail and includes a mount plate for cabinet attachment and a toothed panel for slidably frictionally interfitting with the drawer rail assembly mounting rail. The toothed panel is integrally joined with the mounting plate along a generally linear juncture and has a mounting rail receiving end spaced away from the linear juncture. The toothed panel further includes a first tooth having front and back planar surfaces and upper and lower generally linear peripheral edges; a second tooth having front and back planar surfaces and upper and lower generally linear peripheral edges; and, a tongue between the first and second teeth having front and back planar surfaces and upper and lower generally linear peripheral edges. The lower peripheral edge of the first tooth and upper peripheral edge of the tongue are generally parallel and define a first slot through the toothed panel opening at the mounting rail receiving end thereof, the shortest distance between the lower peripheral edge of the first tooth and the upper peripheral edge of the tongue being greater than the thickness of the first flange. The upper peripheral edge of the second tooth and the lower peripheral edge of the tongue are generally parallel and define a second slot through the toothed panel opening at the mounting rail receiving end thereof, the shortest distance between the upper peripheral edge of the second tooth and the lower peripheral edge of the tongue being greater than the thickness of the second flange. The mounting bracket is sized and dimensioned such that when the rear end of one of the mounting rails engages the mounting rail receiving end of and slidably frictionally interfits with said mounting bracket the back planar surface of the tongue contacts the front planar surface of the elongate panel of the mounting rail, and, the front planar surface of the first and second teeth contact the rear surfaces of the third and fourth flanges. The mounting bracket can also be shaped and dimensioned such that when the rear end of one of the mounting rails engages the mounting rail receiving end of and slidably frictionally interfits with the mounting bracket, one of the following peripheral edge pairs will contact the first and second flanges: (a) the upper and lower peripheral edges of the tongue will contact the lower planar surface of the first flange and upper planar surface of the second flange, (b) the lower peripheral edge of the first tooth and upper peripheral edge of the second tooth contact the upper planar surface of the first flange and lower planar surface of the second flange, (c) the upper peripheral edges of the tongue and second tooth will contact the lower planar surfaces of the first and second flanges, and (d) the lower peripheral edges of the tongue and first tooth contact the upper planar surfaces of the first and second flanges.

Turning now to the drawings, which depict the presently preferred embodiments of the invention for the purpose of illustrating the practice thereof and not by way of limitation of the scope of the invention, and in which like reference characters represent corresponding elements throughout the several views, FIGS. 1–6 illustrate a drawer mounting rail and mounting bracket 12 constructed in accordance with the principles of the invention. The drawer mounting rail includes longitudinal axis 10, rear end 13 and elongate panel 11 having planar front 14 and rear 15 surfaces and spaced apart elongate edges 16, 17. Flanges 18, 19 are integrally attached to edges 16 and 17, include outer edges 25, 26 generally parallel to axis 10, and extend outwardly away from and perpendicular to front surface 14 of panel 11. Flange 18 includes planar upper 20 and lower 24 surfaces generally parallel to one another and to longitudinal axis 10. Flange 19 includes planar upper 22 and lower 23 surfaces generally parallel to one another and to axis 10. Flanges 28, 29 are formed integral with edges 25, 26 and extend outwardly away from panel 11 and flanges 18, 19. Flange 28 includes planar front 30 and rear 31 surfaces. Flange 29 includes planar front 32 and rear 33 surfaces. Surfaces 30–33 are generally parallel to one another, to axis 10, and to front face 14 of panel 11. Wings 35 and 36 are integral with flanges 28 and 29 and are parallel to axis 10 and surfaces 20–23 of flanges 18, 19. A plurality of orifices 37 and isthmuses 38 are formed through panel 11. Panel 11, flanges 18, 19, 28, 29 and wings 35, 36 extend to end 13 of the mounting rail. When the drawer rail assembly is completely assembled in a cabinet a roller moves along and between wings 35, 36.

Mounting bracket 12 includes mount plate 39 and toothed plate 40. Plate 39 is provided with orifice 41 and isthmuses 42 formed therethrough. Plates 39, 40 are integrally attached along linear juncture 43. Plate 40 includes teeth 44, 45 and tongue 46. Tooth 44 is provided with upper 47 and lower 48 linear parallel peripheral edges. Tongue 46 includes upper 49 and lower 50 linear peripheral edges. Linear parallel peripheral edges 51 and 52 of tooth 45 are parallel to peripheral edges 47–50. As shown in FIGS. 1 to 4 and 6, linear edges 48, 49 generally define one slot in plate 40 opening toward the rail receiving end 53 of plate 40 while linear peripheral edges 50, 51 form a second slot in plate 40 opening toward the mount rail receiving end 53 thereof.

FIGS. 4 and 5 illustrate front 55 and rear 58 planar surfaces of tooth 44, front 57 and rear 60 planar surfaces of tooth 45, and, front planar surface 56 and rear planar surface 59 of tongue 46. Planar surfaces 55, 56, 57 all lie in a common imaginary plane. Planar surfaces 58, 59, 60 all lie in a common imaginary plane parallel to the imaginary plane passing through surfaces 55–57.

The shortest distance between parallel peripheral edges 48, 51 is represented in FIGS. 3 and 4 by arrows T. Arrows D represent the shortest distance between parallel peripheral edges 49, 50.

In FIGS. 3, 4, 5 arrows F represent the shortest distance between planar surfaces 20, 23 of flanges 18, 19 of the mounting rail. In FIG. 6 arrow G indicates the shortest distance between planar surfaces 21, 22 of flanges 18, 19. The shortest distance between outer edges 70, 71 and 47, 52 of the mounting bracket is represented in FIG. 4 by arrows E.

In FIG. 5 the thickness of toothed panel 40 is indicated by arrows S. The thickness S of plate 40 is, to insure a tight frictional fit when toothed panel 40 is interfit with end 13 of the mounting rail, generally equivalent to the shortest distance between a first imaginary plane passing through all points on face 14 of panel 11 and a second imaginary plane passing through all points on planar surfaces 31, 33 of flanges 28, 29. When the thickness of toothed panel 40 is equivalent to or slightly greater than the distance between the imaginary plane passing through all points on surface 14 and the plane passing through all points on surfaces 31 and 33, then when toothed panel 40 is slid onto end 13 of the mounting rail in the direction of arrow R in FIG. 3, surface 59 of tongue 46 contacts and frictionally slides over surface 14 of panel 11 and surfaces 33, 31 contact and frictionally slide over surfaces 55, 57 of teeth 44 and 45, respectively.

The shortest distance between each peripheral edge pair 48, 49 and 50, 51 is greater than the thickness of each flange 18, 19. For instance, the shortest distance between edges 48, 49 is greater than the shortest distance between parallel planar surfaces 22, 23 of flange 19. Providing toothed plate 40 with slots having a width greater than flanges 18 and 19 enables the mounting bracket 12 to be utilized on mounting rails of varying size. For example, in FIG. 2 the shortest distance between surfaces 21, 22 of the mounting rail is generally equivalent to the shortest distance between peripheral edges 48, 51. As a result, when bracket 12 is interfit over end 13 of the mounting rail, edges 48, 51 contact and slide over surfaces 21 and 22, respectively. Since the shortest distance between surfaces 20, 23 in FIG. 2 is greater than the shortest distance between edges 49, 50 of tongue 46, edges 49 and 50 do not contact flanges 18, 19.

In contrast, the mounting rail shown in ghost outline in FIGS. 3 and 4 is of a different size than the mounting rail of FIG. 2. In the mounting rail of FIGS. 3 and 4 the shortest distance F between surfaces 20, 23 is equal to the shortest distance D between peripheral support edges 49 and 50 of tongue 46; consequently, edges 49, 50 slide along and contact surfaces 20 and 23 when the mounting rail is slidably interfit with toothed plate 40 in the manner shown in FIG. 3. As can be most easily seen in FIG. 4, the outer surfaces 21, 22 of flanges 18, 19 do not contact peripheral edges 48, 51 because the shortest distance between surfaces 21, 22 is less than the shortest distance between flanges 18, 19.

The mounting rail shown in ghost outline in FIG. 6 is differently dimensioned than either the rail of FIGS. 3 and 4 or the rail of FIG. 5. In FIG. 6, the distance F between inner planar surfaces 20, 23 of flanges 18, 19 is greater than the distance D between peripheral support edges 49, 50 of tongue 46. Further, the shortest distance G between outer planar surfaces 21, 22 of flanges 18, 19 is less than the shortest distance T between peripheral support edges 48, 51. Consequently, the mounting rail can, as shown in FIG. 6, be interfit with the mounting bracket such that surfaces 20, 22 will contact peripheral support edges 50, 48, respectively. End 13 of the mounting rail of FIG. 6 can also be interfit with bracket 12 such that surfaces 21, 23 will contact support edges 51, 49, respectively.

The bracket of the invention prevents the vertical displacement of rail end 13 of a drawer assembly mounting rail by holding end 13 between a pair of peripheral support edges 48–51. Lateral displacement of end 13 of the mounting rail is prevented by tongue 46 and teeth 44, 45 which contact panel 11 and flanges 29 and 28, respectively. Tongue 46 and teeth 44, 45 are substantially rigid. However, tongue 46 may also bear against surface 14 of panel 11 with a force indicated by arrow X in FIG. 4. Surfaces 55, 57 may similarly bear against surfaces 31, 33 of flanges 28, 29 with a force represented by arrow Y. The magnitude of forces X, Y can be controlled by varying the thickness S of plate 40. When thickness S is slightly greater than the distance between a plane passing through all points on surface 14 and a plane passing through all points on surfaces 31 and 33 then the forces X and Y are of greater magnitude. If thickness S is merely equal to the shortest distance between said imaginary planes, the forces X and Y are minimal or non-existant and only the frictional resistance caused by the contact of surfaces 59 and 14, 55 and 33, and, 57 and 31 remains.

In use, the forward end of the mounting rail of FIG. 1 is attached to a cabinet by passing a nail or screw through an isthmus 38 into the cabinet. Mounting bracket 12 is then slidably interfit on end 13 in the direction of arrow R in FIG. 3 and screws are passed through orifice 41 or isthmuses 42 into the cabinet to secure bracket 12 and mounting rail in fixed position in the cabinet.

The thickness of plate 12 is indicated by arrows S in FIG. 5. As earlier noted thickness S of plate 12 generally corresponds to the shortest distance between an imaginary plane passing through all points on surface 14 and an imaginary plane passing through all points on surfaces 31, 33. The tolerances for plate 12, which is preferably fabricated from steel or aluminum, are narrow and must be within 0.01 inch of the shortest distance between the imaginary plane passing through surface 14 and the plane passing through surfaces 31, 33. If, for example, the shortest distance between the imaginary plane passing through surface 14 and the plane passing through surfaces 31, 33 is 0.06 inch, the thickness S of plate 12 must be 0.06 inch plus or minus 0.01 inch.

Having described my invention in such terms as to enable those skilled in the art to understand and practice it, and having identified the presently preferred embodiments thereof, I claim:

1. In combination with the mounting rail of either of a pair of drawer rail assemblies, said mounting rail of each of said drawer rail assemblies having a rear end and including an elongate panel having
planar front and back surfaces,
a longitudinal axis, and
a pair of opposed edges generally parallel to one another and said longitudinal axis, the shortest distance between said opposed edges being different for each of said drawer rail assemblies, first and second opposed flanges attached to said elongate panel along said edges thereof and outwardly extending from said front surface thereof, said flanges each having
generally planar parallel upper and lower surfaces, and
an outer edge spaced away from and generally parallel to said elongate panel, the shortest distance between said upper and lower planar surfaces of each of said first and second flanges comprising the thickness of each flange, third and fourth flanges each attached to one of said outer edges of said first and second flanges, said third and fourth flanges
each having generally planar parallel forward and rear surfaces generally parallel to said elongate panel, and
extending outwardly away from said first and second flanges and said panel member, said rear surfaces of said third and fourth flanges generally lying in the same imaginary plane, an imaginary plane passing through said front surface of said elongate panel being generally parallel to and spaced apart from said imaginary plane passing through said rear surfaces of said third and fourth flanges, said elongate panel and first, second, third and fourth flanges terminating at said rear end of said mounting rail, a one piece mounting bracket for slidably frictionally engaging and supporting said mounting rail and including a mount plate for cabinet attachment and a toothed panel to slidably frictionally interfit with said drawer rail assembly mounting rail, said toothed panel being integrally joined with said mounting plate along a generally linear juncture and having a mounting rail receiving end spaced away from said linear juncture and including (a) a first tooth having front and back planar surfaces and upper and lower generally linear peripheral edges;

(b) a second tooth having front and back planar surfaces and upper and lower generally linear peripheral edges;

(c) a tongue between said first and second teeth and having front and back planar surfaces and upper and lower generally linear peripheral edges;

said lower peripheral edge of said first tooth and upper peripheral edge of said tongue generally being parallel and defining a first slot through said toothed panel opening at said mounting rail receiving end thereof, the shortest distance between said lower peripheral edge of said first tooth and said upper peripheral edge of said tongue being greater than said thickness of said first flange, said upper peripheral edge of said second tooth and said lower peripheral edge of said tongue being generally parallel and defining a second slot through said toothed panel opening at said mounting rail receiving end thereof, the shortest distance between said upper peripheral edge of said second tooth and said lower peripheral edge of said tongue being greater than said thickness of said second flange, said mounting bracket being sized and dimensioned such that when said rear end of one of said mounting rails engages said mounting rail receiving end of and slidably frictionally interfits with said mount bracket, (d) said back planar surface of said tongue contacts said front planar surface of said elongate panel of said mounting rail; and, (e) said front planar surfaces of said first and second teeth contact said rear surfaces of said third and fourth flanges.

2. The combination of claim 1 wherein said mounting bracket is sized and dimensioned such that when said rear end of one of said mounting rails engages said mounting rail receiving end of and slidably frictionally interfits with said mounting bracket, (a) said back planar surface of said tongue contacts said front planar surface of said elongate panel of said mounting rail;

(b) said front planar surfaces of said first and second teeth contact said rear surfaces of said third and fourth flanges;

(c) one of the following peripheral edge pairs will contact said first and second flanges, (i) said upper and lower peripheral edges of said tongue contact said lower planar surface of said first flange and upper planar surface of said second flange, (ii) said lower peripheral edge of said first tooth and said upper peripheral edge of said second tooth contact said upper planar surface of said first flange and said lower planar surface of said second flange, (iii) said upper peripheral edges of said tongue and said second tooth contact said lower planar surfaces of said first and second flanges, and (iv) said lower peripheral edges of said tongue and first tooth contact said upper planar surfaces of said first and second flanges.

* * * * *